US007524278B2

(12) United States Patent
Madsen et al.

(10) Patent No.: US 7,524,278 B2
(45) Date of Patent: Apr. 28, 2009

(54) HEARING AID SYSTEM AND TRANSDUCER WITH HERMETICALLY SEALED HOUSING

(75) Inventors: Clair Madsen, Maple Grove, MN (US); Michael A. Schugt, St. Paul, MN (US)

(73) Assignee: Envoy Medical Corporation, Minneapolis, MN (US)

( * ) Notice: Subject to any disclaimer, the term of this patent is extended or adjusted under 35 U.S.C. 154(b) by 453 days.

(21) Appl. No.: 10/848,785

(22) Filed: May 19, 2004

(65) Prior Publication Data

US 2004/0264725 A1 Dec. 30, 2004

Related U.S. Application Data

(60) Provisional application No. 60/470,984, filed on May 19, 2003.

(51) Int. Cl.
*H04R 25/00* (2006.01)

(52) U.S. Cl. ..... 600/25

(58) Field of Classification Search ..... 600/25, 600/300, 379, 559; 73/585; 181/126–137; 330/65; 381/23.1, 312–331; 607/46, 55–57, 607/136–137; 623/10, 24
See application file for complete search history.

(56) References Cited

U.S. PATENT DOCUMENTS

| | | | | |
|---|---|---|---|---|
| 3,187,639 | A | 6/1965 | Kelly et al. | |
| 5,085,628 | A * | 2/1992 | Engebretson et al. | 600/25 |
| 5,105,811 | A * | 4/1992 | Kuzma | 607/57 |
| D332,793 | S | 1/1993 | Jankowiak | |
| 5,277,694 | A | 1/1994 | Leysieffer et al. | |
| 5,282,858 | A * | 2/1994 | Bisch et al. | 623/10 |
| 5,549,658 | A * | 8/1996 | Shannon et al. | 607/57 |
| 5,814,095 | A | 9/1998 | Muller et al. | |
| 5,842,967 | A * | 12/1998 | Kroll | 600/25 |
| 5,857,958 | A * | 1/1999 | Ball et al. | 600/25 |
| 5,881,158 | A | 3/1999 | Lesinski et al. | |
| 5,932,360 | A | 8/1999 | Hazlitt et al. | |
| 5,977,689 | A | 11/1999 | Neukermans | |
| 6,005,955 | A | 12/1999 | Kroll et al. | |
| 6,093,144 | A * | 7/2000 | Jaeger et al. | 600/25 |
| 6,153,966 | A | 11/2000 | Neukermans | |
| 6,171,229 | B1 * | 1/2001 | Kroll et al. | 600/25 |
| 6,251,062 | B1 | 6/2001 | Leysieffer | |
| 6,381,336 | B1 | 4/2002 | Lesinski et al. | |
| 6,537,201 | B1 | 3/2003 | Kasie, II et al. | |
| 6,730,015 | B2 | 5/2004 | Schugt et al. | |
| 6,736,770 | B2 | 5/2004 | Leysieffer et al. | |
| 2003/0065244 | A1 * | 4/2003 | Kasic et al. | 600/25 |

* cited by examiner

*Primary Examiner*—Samuel G Gilbert
(74) *Attorney, Agent, or Firm*—Fredrikson & Byron, P.A.

(57) ABSTRACT

A driver and sensor assembly that is hermetically sealed so that the assemblies may be fully implanted in a being. The assemblies employ a transducer that has a longitudinal axis and that vibrates or picks up vibration in a direction substantially transverse to its longitudinal axis. A sheath covers the transducer and is hermetically sealed to a housing. Leads from a sound processor are coupled to the housing and the entire assembly is hermetically sealed.

26 Claims, 11 Drawing Sheets

HEARING AID SYSTEM AND TRANSDUCER WITH HERMETICALLY SEALED HOUSING

RELATED APPLICATIONS

This application claims priority to U.S. Provisional Application No. 60/470,984, filed May 19, 2003, which is specifically incorporated by reference herein.

FIELD OF THE INVENTION

This invention relates to an electromechanical transducer for use in a hearing system that is at least partially implantable in a middle ear.

BACKGROUND OF THE INVENTION

In some types of partial middle ear implantable (P-MEI) or total middle ear implantable (T-MEI) hearing aid systems, piezoelectric transducers are used in which sounds produce mechanical vibrations which are transduced by an electromechanical input transducer into electrical signals. These electrical signals are in turn amplified and applied to an electromechanical output transducer. The electromechanical output transducer vibrates an ossicular bone in response to the applied amplified electrical signals to improve hearing.

Because of the transducers location, they need to be protected from the ambient environment. In particular, the transducers need to provide moisture, microbial and tissue adhesion resistance. In addition, they need to be biocompatible. Also, the protection provided must have a low spring rate and low mass loading to not interfere with the operation of the transducer and to minimize vibrational transmission losses to the middle ear ossicles.

SUMMARY OF THE INVENTION

According to a first aspect of the invention, there is provided a hearing aid device having a transducer assembly, a sheath and a housing. The transducer assembly has a proximal and distal end and a longitudinal axis coupling the proximal and distal end of the transducer assembly. The sheath is disposed over the transducer assembly and coaxial therewith, the sheath having a proximal end and a distal end. The housing is disposed over the proximal end of the transducer assembly. The proximal end of the sheath is hermetically sealed to the housing and the distal end of the sheath is hermetically sealed about the distal end of the transducer assembly. According to a second aspect of the invention, there is provided a device for hermetically sealing a hearing aid device having a transducer having a proximal end and a distal end and a longitudinal axis coupling the proximal and distal ends of the transducer. The device includes a sheath and a pin. The sheath has a proximal end and a distal end and defines a lumen there between wherein the lumen is dimensioned to receive the transducer therein. The pin is located at the distal end of the sheath wherein the sheath is hermetically sealed about the transducer.

BRIEF DESCRIPTION OF THE DRAWINGS

In the drawings, like numerals describe like components throughout the several views.

DETAILED DESCRIPTION OF THE EMBODIMENTS OF THE INVENTION

Figure 1:
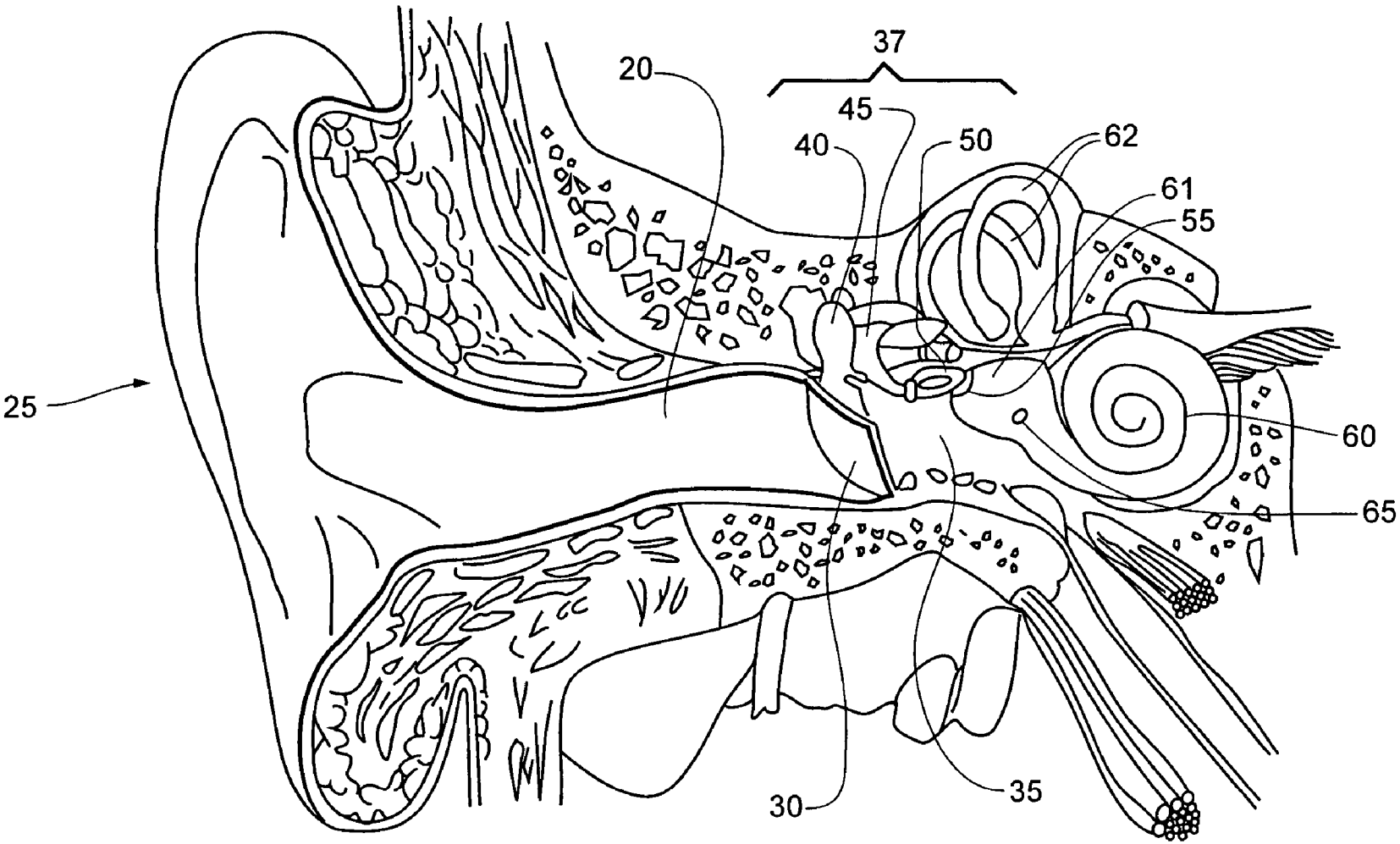
FIG. 1 illustrates a frontal section of an anatomically normal human right ear.

The embodiments of the invention provide an electromechanical transducer which is particularly advantageous when used in a middle ear implantable hearing aid system, such as a partial middle ear implantable (P-MEI), total middle ear implantable (T-MEI), or other hearing aid system. A P-MEI or T-MEI hearing aid system assists the human auditory system in converting acoustic energy contained within sound waves into electrochemical signals delivered to the brain and interpreted as sound. FIG. 1 illustrates, generally, the human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the tympanic membrane (eardrum) 30, interposed at the terminus of the external auditory canal, between it and the tympanic cavity (middle ear) 35. Variations in the sound waves produce tympanic vibrations. The mechanical energy of the tympanic vibrations is communicated to the inner ear, comprising cochlea 60, vestibule 61, and semicircular canals 62, by a sequence of articulating bones located in the middle ear 35. This sequence of articulating bones is referred to generally as the ossicular chain 37. Thus, the ossicular chain transforms acoustic energy at the eardrum to mechanical energy at the cochlea 60.

The ossicular chain 37 includes three primary components: a malleus 40, an incus 45, and a stapes 50. The malleus 40 includes manubrium and head portions. The manubrium of the malleus 40 attaches to the tympanic membrane 30. The head of the malleus 40 articulates with one end of the incus 45. The incus 45 normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus 45 articulates the capitulum of the stapes 50 to complete the mechanical transmission path.

Normally, prior to implantation of the hearing aid system according to the embodiments of the invention, tympanic vibrations are mechanically conducted through the malleus 40, incus 45, and stapes 50, to the oval window 55. Vibrations at the oval window 55 are conducted into the fluidfilled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain 37, and/or cochlea 60 can disrupt or impair normal hearing.

Hearing loss due to damage in the cochlea is referred to as sensorineural hearing loss. Hearing loss due to an inability to conduct mechanical vibrations through the middle ear is referred to as conductive hearing loss. Some patients have an ossicular chain 37 lacking sufficient resiliency to transmit mechanical vibrations between the tympanis membrane 30 and the oval window 55. As a result, fluidic motion in the cochlea 60 is attenuated. Thus, receptor cells in the cochlea 60 do not receive adequate mechanical stimulation. Damaged elements of ossicular chain 37 may also interrupt transmission of mechanical vibrations between the tympanic membrane 30 and the oval window 55.

Implantable hearing aid systems have been developed, utilizing various approaches to compensate for hearing disorders. For example, cochlear implant techniques implement an inner ear hearing aid system. Cochlear implants electrically stimulate auditory nerve fibers within the cochlea 60. A typical cochlear implant system includes an external microphone, an external signal processor, and an external transmitter, as well as an implanted receiver and an implanted single channel or multichannel probe. In the more advanced multichannel cochlear implant, a signal processor converts speech signals transduced by the microphone into a series of sequential electrical pulses corresponding to different frequency bands within a speech frequency spectrum. Electrical pulses corresponding to low frequency sounds are delivered to electrodes that are more apical in the cochlea 60.

A particularly interesting class of hearing aid systems includes those which are configured for disposition principally within the middle ear space 35. In middle ear implantable (MEI) hearing aids, an electrical-to-mechanical output transducer couples mechanical vibrations to the ossicular chain 37, which is optionally interrupted to allow coupling of the mechanical vibrations to the ossicular chain 37. Both electromagnetic and piezoelectric output transducers have been used to effect the mechanical vibrations upon the ossicular chain 37.

One example of a partial middle ear implantable (P-MEI) hearing aid system having an electromagnetic output transducer comprises; an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus. Such electromagnetic output transducers have relatively high power consumption, which limits their usefulness in total middle ear implantable (T-MEI) hearing aid systems.

A piezoelectric output transducer is also capable of effecting mechanical vibrations to the ossicular chain 37. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed. A resulting electrical signal is provided to an electrical-to-mechanical piezoelectric output transducer that generates a mechanical vibration coupled to an element of the ossicular chain 37 or to the oval window 55 or round window 65. In the '366 patent, the ossicular chain 37 is interrupted by removal of the incus 45. Removal of the incus 45 prevents the mechanical vibrations delivered by the piezoelectric output transducer from mechanically feeding back to the piezoelectric input transducer.

Piezoelectric output transducers have several advantages over electromagnetic output transducers. The smaller size or volume of the piezoelectric output transducer advantageously eases implantation into the middle ear 35. The lower power consumption of the piezoelectric output transducer is particularly attractive for T-MEI hearing aid systems, which include a limited longevity implanted battery as a power source.

A piezoelectric output transducer is typically implemented as a ceramic piezo electric bi-element transducer, which is a cantilevered double plate ceramic element in which two opposing plates are bonded together such that they amplify a piezo electric action in a direction normal to the bonding plane. Such a bi-element transducer vibrates according to a potential difference applied between the two bonded plates. A proximal end of such a bi-element transducer is typically cantilevered from a transducer mount which is secured to a temporal bone within the middle ear. A distal end of such a bi-element transducer couples mechanical vibrations to an ossicular element such as stapes 50.

Figure 2:
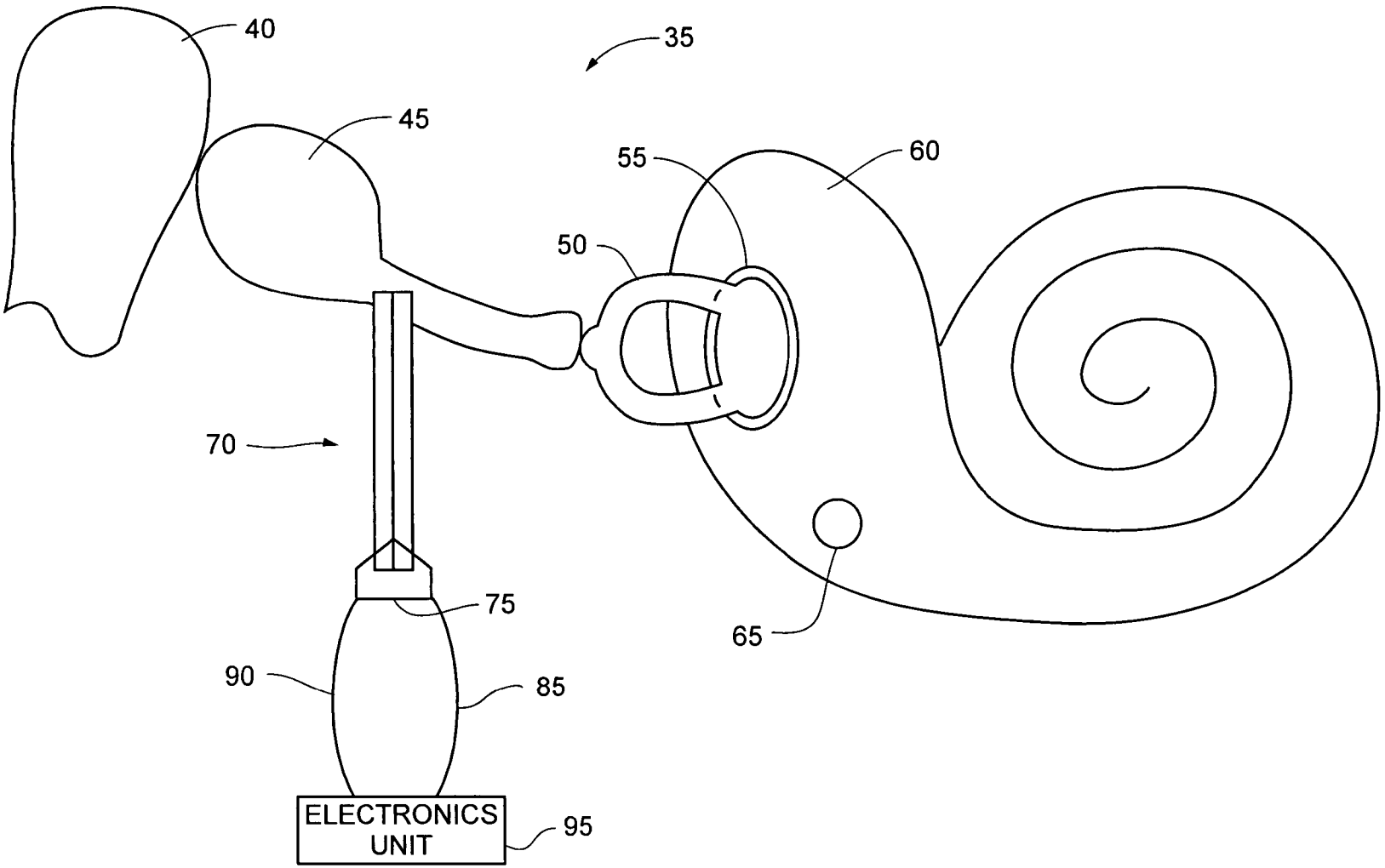
FIG. 2 is a cross-sectional illustration of a typical use of a bi-element transducer coupled to an auditory element in the middle ear.

FIG. 2 is a generalized illustration of a bi-element transducer 70 cantilevered at its proximal end from a mount 75 secured to a temporal bone within middle ear 35. A distal end of bi-element transducer 70 is mechanically coupled to an auditory element to receive or effect mechanical vibrations when operating as an input or output transducer respectively. For example, to receive mechanical vibrations as an input transducer, bi-element transducer 70 may be coupled to an auditory element such as a tympanic membrane 30, malleus 40, or incus 45. In another example, to effect vibrations as an output transducer, bi-element transducer 70 may be coupled to an auditory element such as incus 45, stapes 50, oval window 55, round window 65, vestibule 61, or semicircular canal 62. The transducer 70 is coupled by leads 85, 90 to an electronics unit 95.

Figure 3:
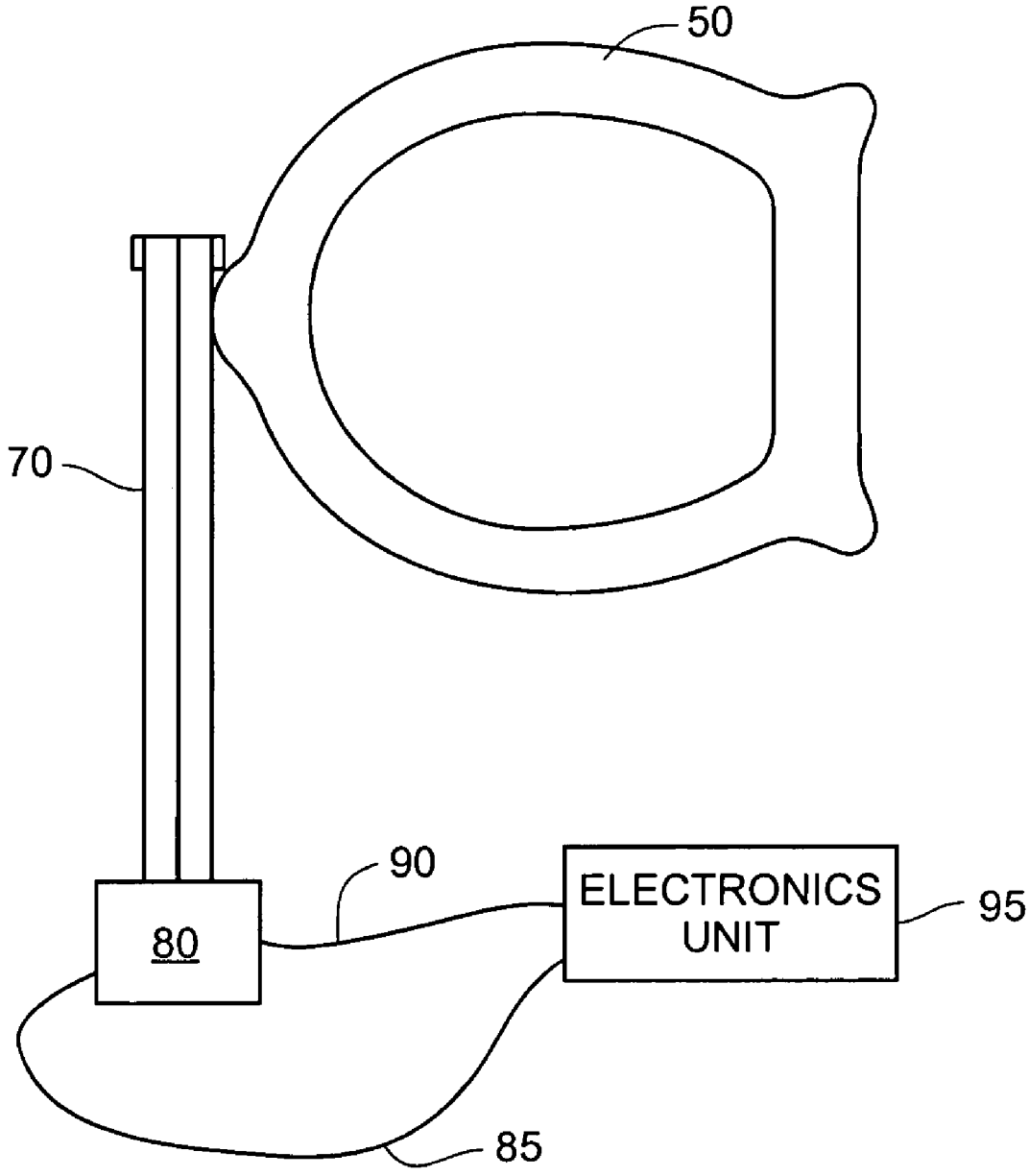
FIG. 3 is a cross-sectional illustration of a bi-element transducer secured only to a vibrated auditory element.

FIG. 3 illustrates generally a cross-sectional view of an electromechanical output transducer. A piezoelectric element, more particularly bi-element transducer 70, is mechanically coupled, and preferably secured, at its proximal end to middle ear 35 only through an auditory element, preferably stapes 50, or alternatively incus 45, stapes 50, oval window 55, round window 65, vestibule 61, or semicircular canals 62. Bi-element transducer 70 is secured only to stapes 50 by any known attachment technique, including biocompatible adhesives or mechanical fasteners. For example, in one embodiment, a deformable wire (not shown) secured to the proximal end of bi-element transducer 70 is looped through an inner portion of stapes 50, for example, and crimped to secure bi-element transducer 70 to stapes 50. The exact technique of attachment to the auditory element is not part of the invention.

Electronics unit 95 couples an electrical signal through lead wires 85 and 90 to any convenient respective connection points on respective opposing elements of bi-element transducer 70. Electronics unit 95 and lead wires 85 and 90 are not part of the invention, but rather show how the invention is used in conjunction with a P-MEI, T-MEI, or other hearing aid system.

In response to the electrical signals received from electronics unit 95, bi-element transducer 70 bends with respect to a longitudinal plane between its opposing elements. The bending is resisted by inertial mass 80, thus mechanically coupling a force to stapes 50 through bi-element transducer 70. This force upon stapes 50 is in turn transmitted to cochlea 60 at oval window 55.

Figure 4:
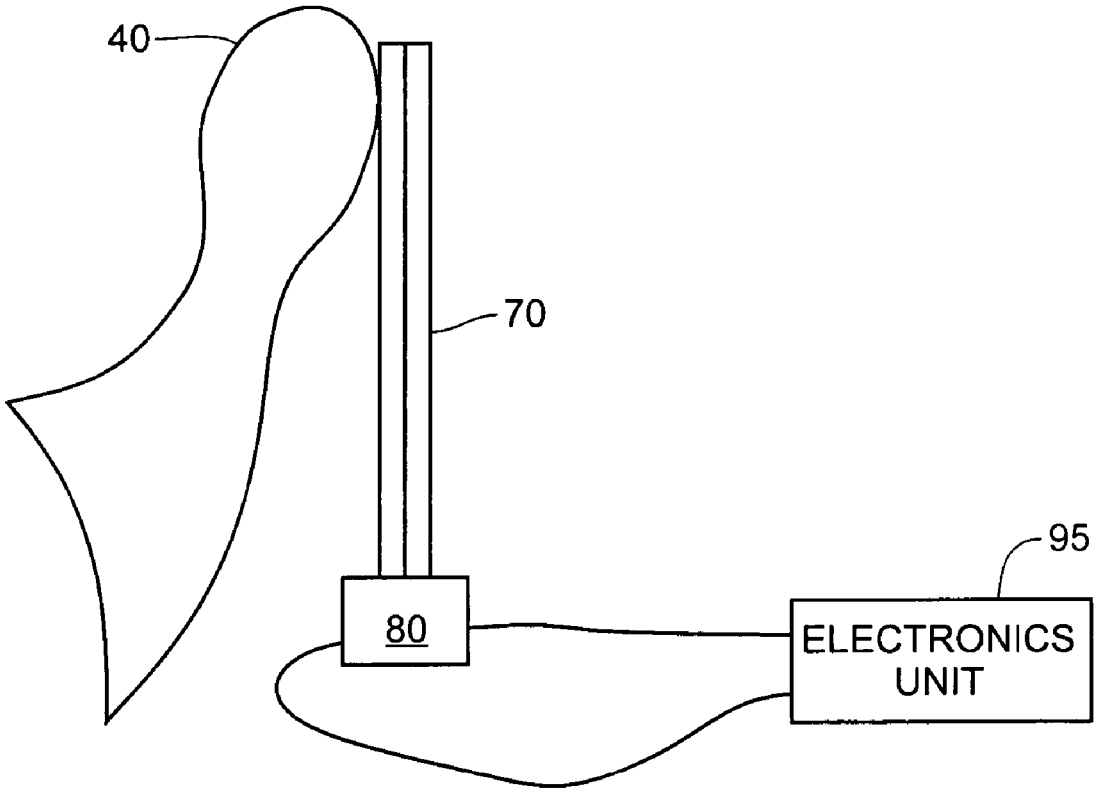
FIG. 4 is a cross-sectional illustration of a bi-element transducer secured only to a vibrating auditory element.

FIG. 4 illustrates generally a cross-sectional view of an electromechanical input transducer. A piezoelectric element, such as bi-element transducer 70, is secured by any known attachment technique at its proximal end, such as described above, only to malleus 40. Bi-element transducer 70 may also be secured only to other auditory elements for receiving mechanical vibrations, such as incus 45 or tympanic membrane 30. Vibrations of malleus 40 cause, at the proximal end of bi-element transducer 70, vibratory displacements that are opposed by inertial mass 80. As a result, bi-element transducer 70 bends with respect to the longitudinal plane between its opposing elements. A resulting electrical signal is provided at any convenient connection point on respective opposing elements of bi-element transducer 70, through respective lead wires 92 and 93 to electronics unit 95.

Figure 5:
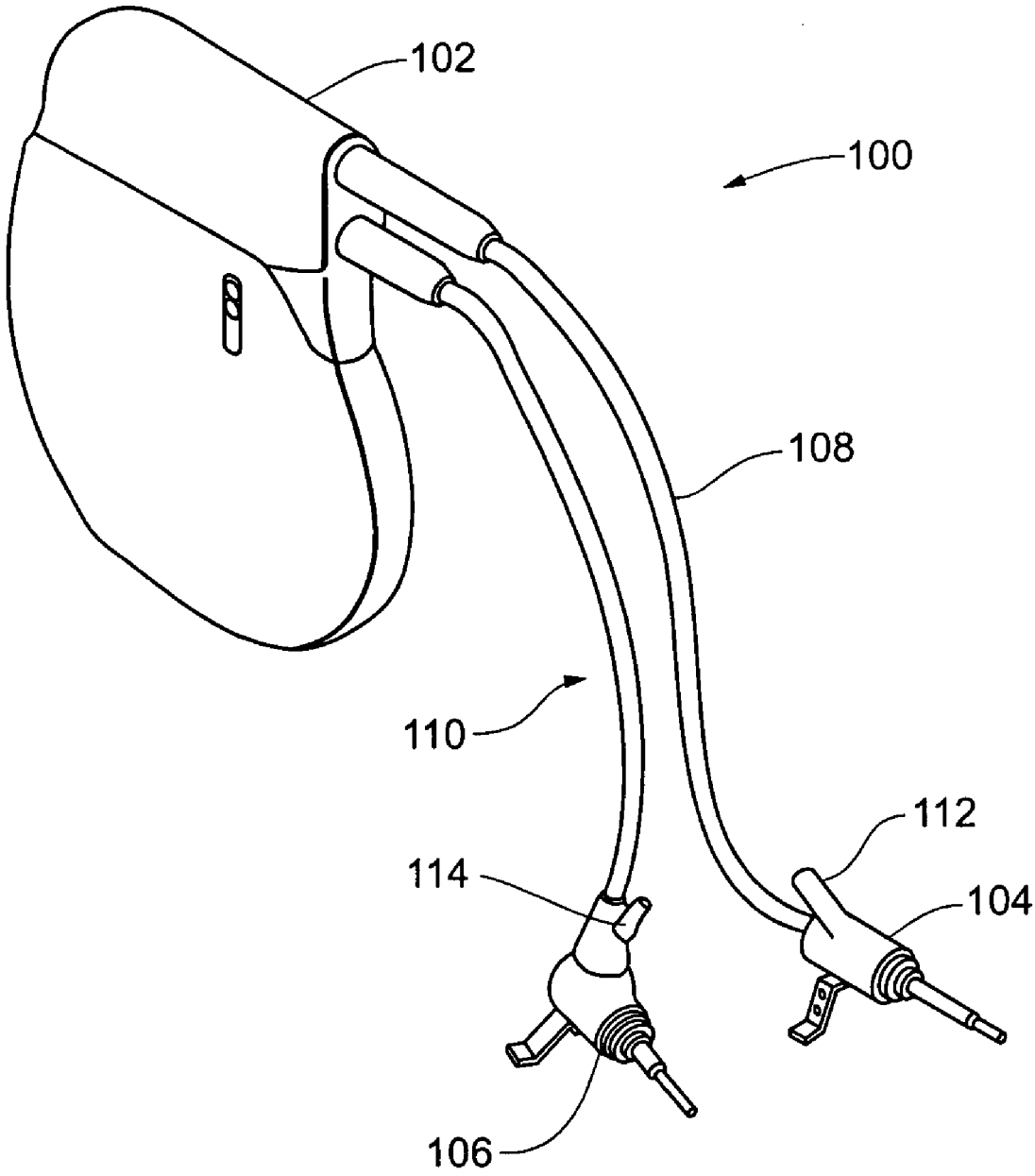
FIG. 5 is a perspective view of a hearing aid system according to an embodiment of the invention.

FIG. 5 is a perspective view of a hearing aid system according to an embodiment of the invention. The hearing aid system 100 includes an electronics unit 102, a driver assembly 104 and a sensor assembly 106 The driver assembly 104 and sensor assembly 106 are coupled to the electronics unit 102 via leads 108, 110 respectively. The driver and sensor assemblies 104, 106 also have installation wires 112, 114 extending therefrom which will be described in detail hereinafter with respect to FIG. 12. The hearing aid system is intended to be completely implantable in a human being. In particular, the hearing aid system is intended to help improve the hearing of human beings with mild to severe sensorineural hearing loss. The sensor assembly 106 is attached to the malleus and/or incus bone and the driver assembly 104 is attached to the stapes in the middle ear as will be described hereinafter. The electronics unit 102 is implanted in the skull preferably behind the ear. The electronics unit 102 includes a sound processor (not shown) and battery (not shown).

The hearing system according to the preferred embodiments described herein, use the ear drum as a microphone, picking up natural sounds through the ear canal. The sensor assembly 106 picks up vibrations from the eardrum and the malleus and/or incus bone and converts the vibrations into electrical signals which are sent to the sound processor 102 via leads 110. The sound processor 102 filters and amplifies the electrical signals and sends them to the driver assembly 104 via leads 108. The sound processor 102 is programmed to customize it for the particular human being in which the hearing aid system is implanted. The sound processor also houses a battery to power the system.

The driver assembly 104 is coupled to the stapes. It converts electrical signals that it has received from the sound processor 102 back into mechanical vibrations. The driver assembly 104 transmits these sound vibrations effectively to the stapes and oval window.

Figure 6:
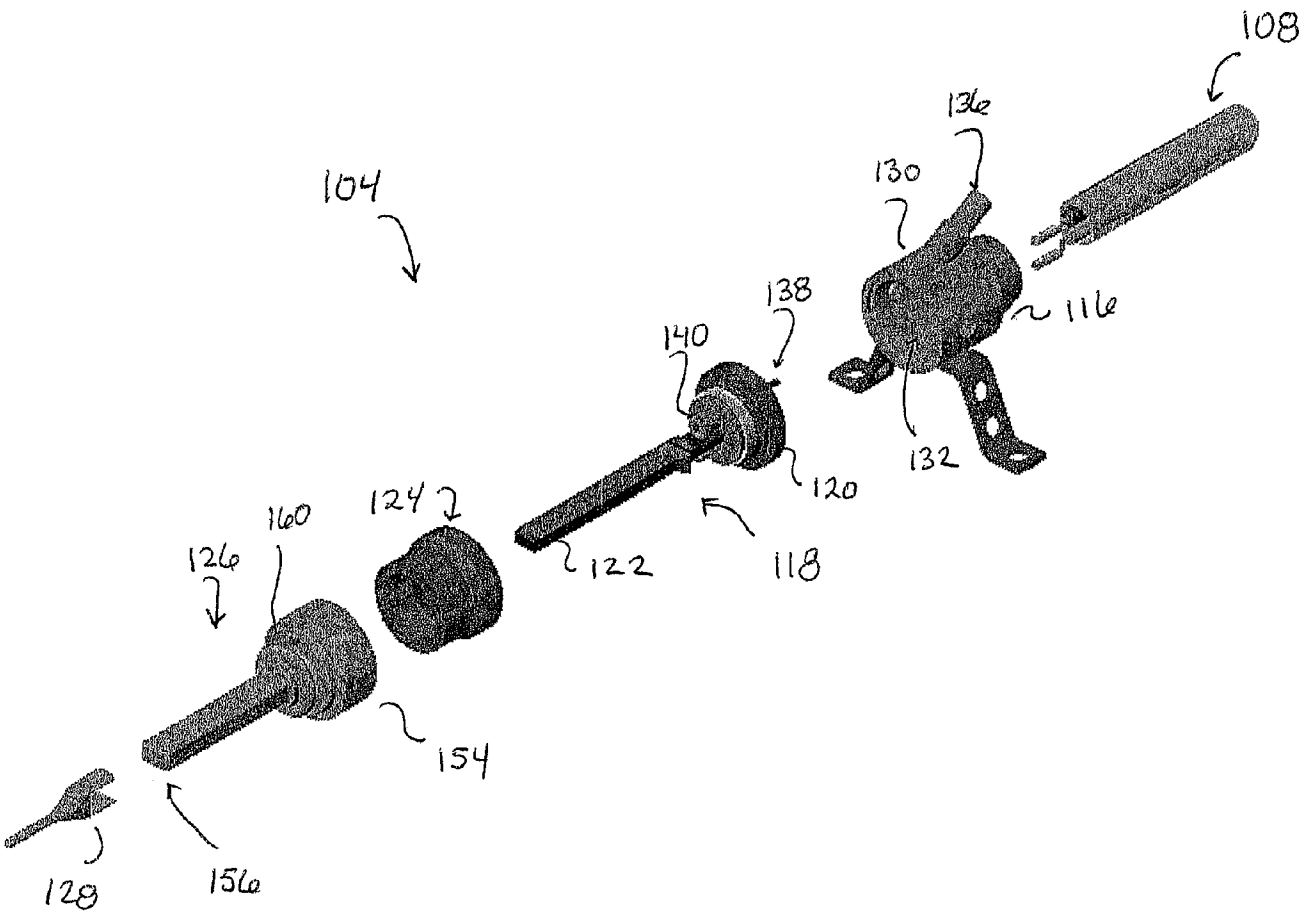
FIG. 6 is a perspective, exploded view of a driver assembly according to an embodiment of the invention.
Figure 7:
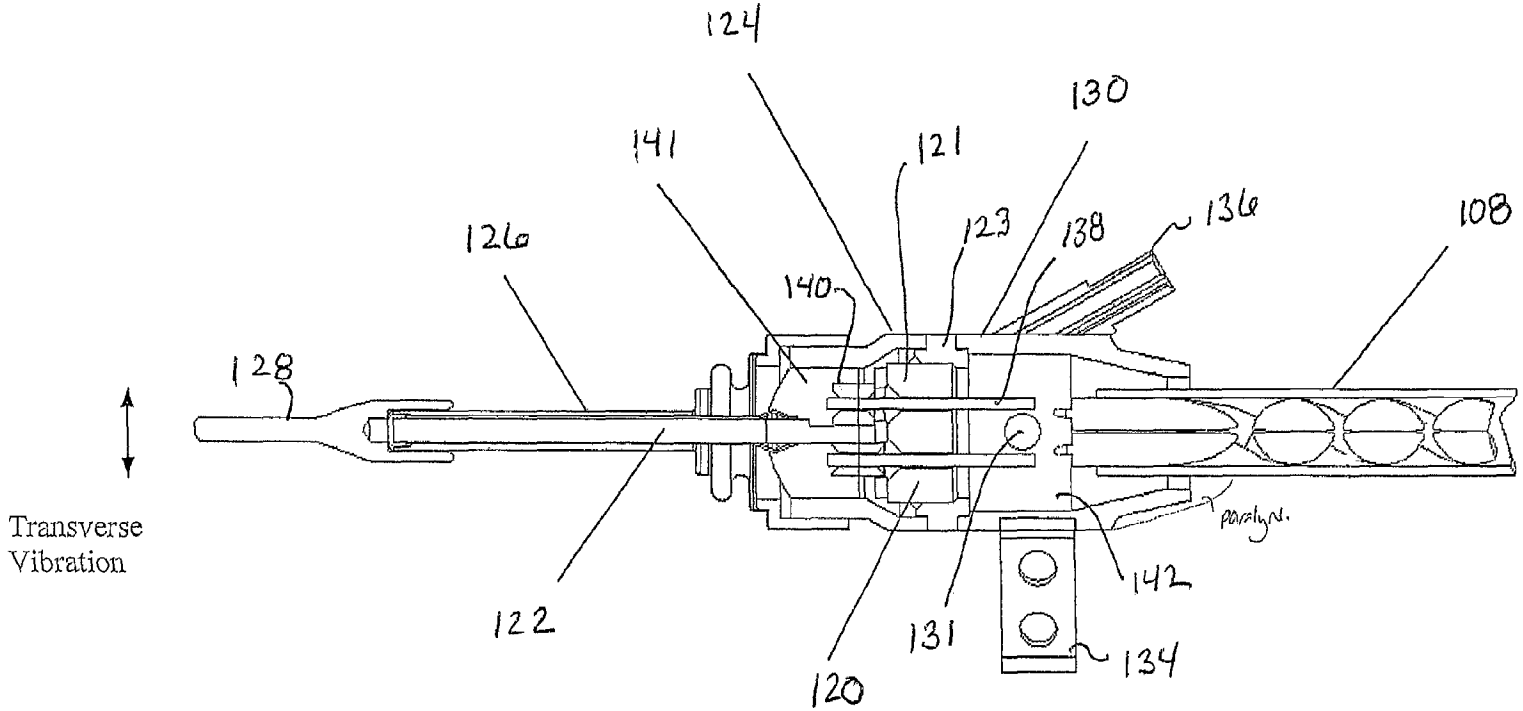
FIG. 7 is a cross sectional view of the driver assembly shown in FIG. 6, assembled.

FIG. 6 is a perspective, exploded view of a driver assembly according to an embodiment of the invention. The driver assembly 104 includes a housing 116, a transducer assembly 118, a weld ring 124, a sheath 126 and a pin 128. The housing 116 is formed substantially by a cylindrical wall 130 with a first lumen 132 extending therethrough. A pair of legs 134 extend from the outer surface of the cylindrical wall 130 to anchor the driver assembly 104 to the mastoid (not shown) of the human being. The legs 134 may be formed as part of the housing 116 or they may be separate members that are secured to the exterior of the housing, for example, by welding. An installation wire socket 136 extends into but not through the cylindrical wall of the housing 116. The transducer assembly 118 includes a feed thru 120 and a transducer 122. The feed thru 120 has a pair of wires or leads 138 that extend therethrough. On one face of the feed thru 120 are projections 140 through which the leads 138 extend so that they can be electrically coupled to the transducer by brazing, welding or soldering, for example. The transducer 122 is secured to the feed thru 120 between these projections 140. The transducer 122 is secured to the feed thru 120 by gluing, bonding soldering, brazing or welding, for example. In an embodiment, the transducer is a piezoelectric transducer that converts mechanical energy to electrical energy and vice versa as is well known to those of ordinary skill in the art. More particularly, the transducer 122 is a cantilevered double plate ceramic element with two opposing plates bonded together such that they amplify a piezoelectric action in a direction substantially normal to the bonding plane. With reference to FIG. 7, the feed thru 140 is composed mainly of two parts, a ceramic disc 121 and a flange 123 encircling the ceramic disc 121. The leads 138 extend through the ceramic disc 121. The flange 123 is made out of metallic or non-metallic material that can be hermetically sealed or coupled to the housing 116 and weld ring 124 as will be described.

The sheath 126 has a proximal end 154 and a distal end 156 coupled together by a longitudinal axis. The proximal end 154 of the sheath 126 is open and the distal end 156 may or may not be open. Extending between the proximal and distal ends is a lumen (not shown) that is dimensioned to house the transducer 122. The sheath has a longitudinal body that generally has a cross-section complementary to the transducer 122. Thus, depending on the shape of the transducer 12, the cross-section of the sheath may be rectangular, square or circular, for example. The pin 128 is located at the distal end 156 of the sheath 126 and may be a separate structure as shown in FIG. 6 or it may be integral to the sheath 126. If the pin 128 and sheath 126 are separate structures, and if the distal end of the sheath 126 is closed, the pin 128 may be bonded to the distal end by an epoxy. If the distal end of the sheath 126 is open, the pin 128 may be hermetically sealed to the open distal end of the sheath 126 by welding, brazing or soldering, for example.

In an embodiment a bellow 160 is located on an exterior surface of the sheath 126 near its proximal end 154. The bellow 160 is a radial projection that is substantially perpendicular to the longitudinal axis of the sheath 126. The bellow 160 may have various shapes such as round, for example. In addition, while only one bellow 160 is illustrated, there may be a plurality of bellows located adjacent to one another. The bellow 160 allows the sheath 126 to move with the movement of the transducer 122 as will be described in further detail hereinafter. Leads 108 extend partially within the lumen 132 of the housing 116 and couple the leads 138 in the transducer assembly 118 to the sound processor 102 shown in FIG. 5.

The housing 116, ring 124 and flange 123 of the feed thru 120 may be made of metallic or non-metallic implantable materials that can be hermetically sealed to the sheath 126. These materials include titanium, platinum, gold, platinum-iridium, stainless steel or plastic. In one embodiment, the sheath 126 is made out of a thin walled metallic or non-metallic material that preferably can be made to follow the profile of the transducer 22, minimize spring constant and mass while providing a hermetic barrier. In a preferred embodiment, the sheath is made of titanium and may have a wall thickness ranging from about 0.0005 inches to about 0.01 inches. More preferably, the sheath 126 has a wall thickness of about 0.002 inches. The housing 116, ring 124 and sheath 126 may be made by die forming, hydroforming, electro-deposition or thin film deposition. The pin 128 may be made of stainless steel, titanium or any implantable metal. In a preferred embodiment, the sheath 126 is made of gold and the pin 128 is made of titanium.

FIG. 7 is a cross sectional view of the driver assembly shown in FIG. 6, assembled. The leads 138 are bonded to the transducer element 122. A portion of the feed thru 120 is positioned in housing 130 and the flange 123 of the feed thru 120 is hermetically sealed to the housing 130. A spacer 131 of medical adhesive is positioned between leads 138 to keep them separated. A primer (not shown) is then applied to the interior of the housing. A thin coating of medical adhesive is then applied over the primer. The leads 108 are electrically coupled to the leads 138. The interior of the housing is then filled with a medical adhesive 142. A ceramic backfill 141 is applied to the transducer assembly in the flange region. The ring 124 is disposed over the transducer assembly 118 so that it abuts the housing 116 and then is hermetically sealed thereto by welding, soldering or brazing, for example. The sheath 126 is then slid over the transducer 122 so that the proximal end of the sheath abuts the ring 124. In an embodiment, before the sheath 126 is slid over the transducer 122, the transducer 122 is coated with an insulation layer or has insulation heat shrunk thereon and then inserted into the lumen of the sheath. In addition, the sheath is filled with an adhesive, cement or epoxy at its distal end to provide direct mechanical contact between the transducer 122 and the sheath 126. The proximal end of the sheath is hermetically sealed to the ring by gluing, soldering, brazing or welding, for example.

The transducer assemblies may also be provided with one or more coatings that may enhance the mechanical and/or biological characteristics of the devices. The coatings may be organic or inorganic and may provide one or more of the following characteristics while maintaining low spring rate and mass loading: scratch and/or moisture resistance, biocompatibility, tissue adhesion resistance, microbial resistance, for example. For instance, a medical adhesive coating may be applied from a point just proximal a distal end of the pin 128 to the housing 116. Over that, a conformal coating may be applied from that point just proximal the distal end of the pin 128 to a portion of the leads 108 extending from the housing.

In another embodiment, the sheath 126 may be formed by coating the transducer assembly 118 with organic or inorganic coatings. Inorganic coatings may consist of a single or multiple layers of formed or deposited metals including titanium, platinum, gold, nickel, copper, palladium cobalt, for example. Organic materials may include Teflon, silicone, parylene, polyeurethane, for example. Coatings may be applied by several well known techniques including dipping the transducer assembling in the materials, rolling it, spraying it on, vapor depositing, electrostatic, ion beam, plasma and vacuum depositing, for example. The coating or coatings may also be surface modified to incorporate desired properties.

Figure 8:
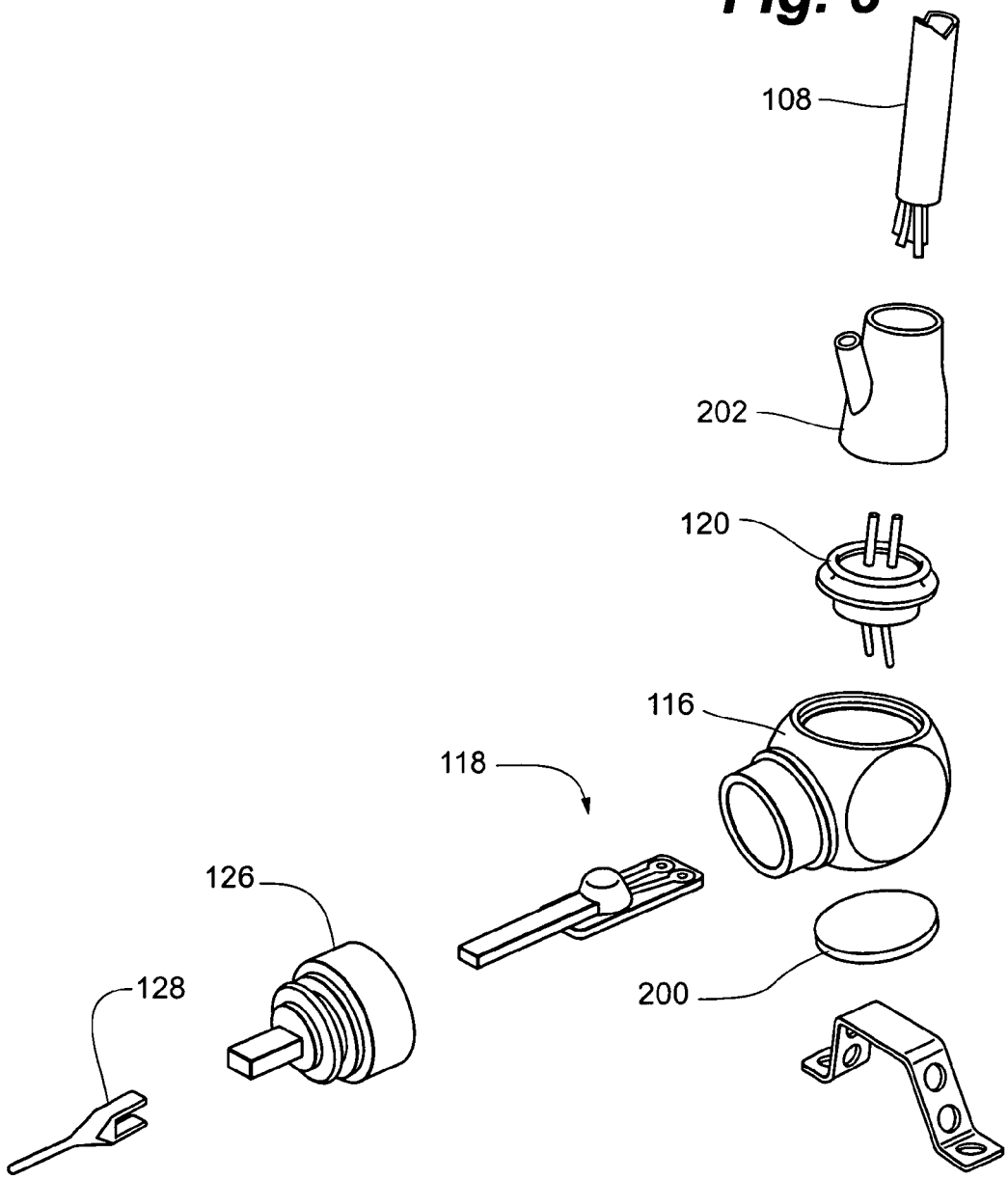
FIG. 8 is a perspective, exploded view of a sensor assembly according to an embodiment of the invention.
Figure 9:
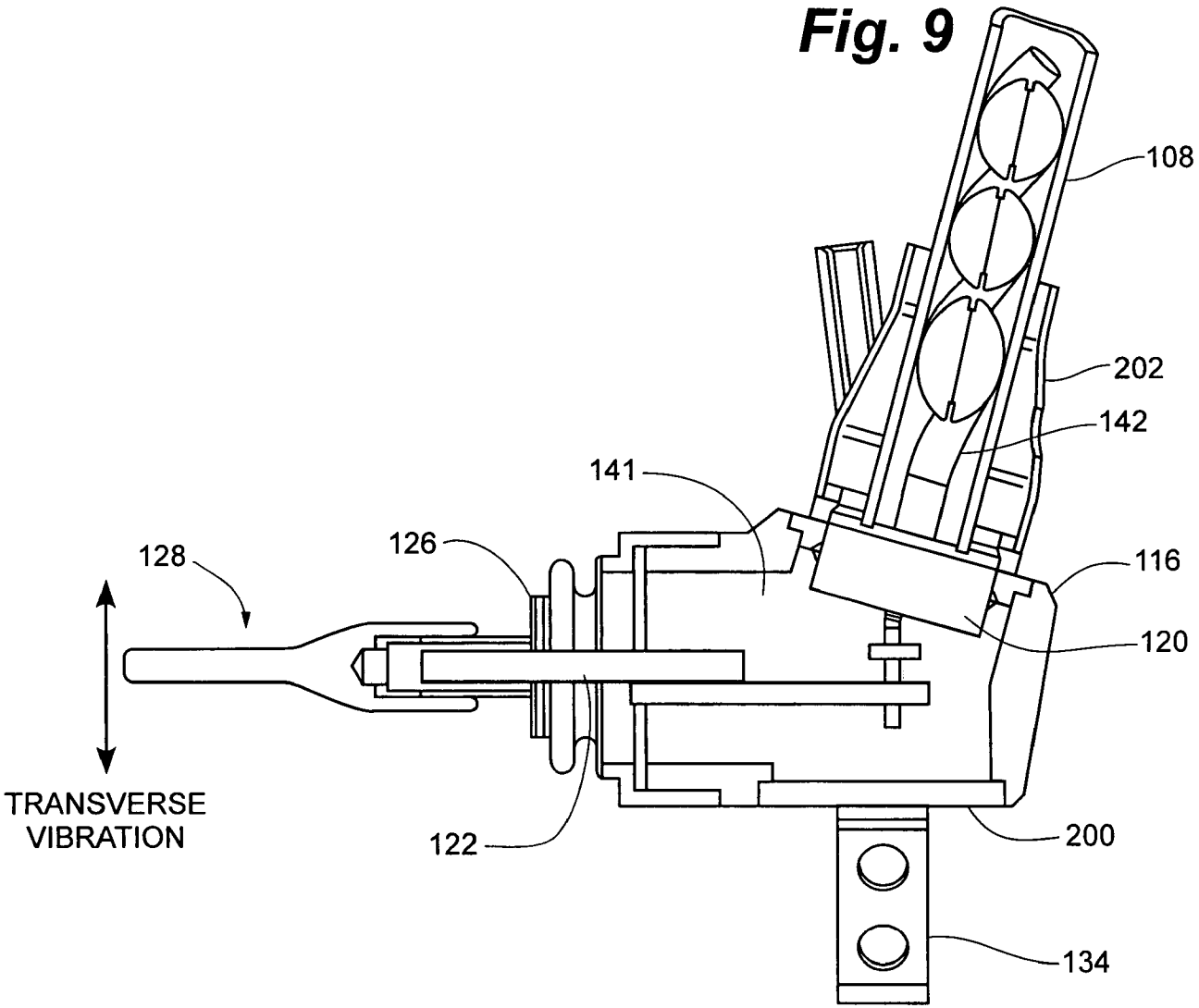
FIG. 9 is a cross sectional view of the sensor assembly shown in FIG. 8.

FIG. 8 is a perspective, exploded view of a sensor assembly according to an embodiment of the invention. The sensor assembly utilizes a very similar design as the driver assembly but it is used to detect vibrations generated by the middle ear ossicles. The same reference numbers are used to identify similar parts. Because of the placement of the senor assembly, the housing is shaped differently and includes a bottom plate 200 to which legs 134 are secured and a shroud assembly 202. Also, for the sensor assembly, a weld ring is not needed. In addition, the length of the transducer and the sheath is shorter than in the driver assembly. Apart from those structural differences, the construction is the same as the driver assembly, and, thus need not be described in greater detail. FIG. 9 is a cross sectional view of the sensor assembly shown in FIG. 8.

Figure 10:
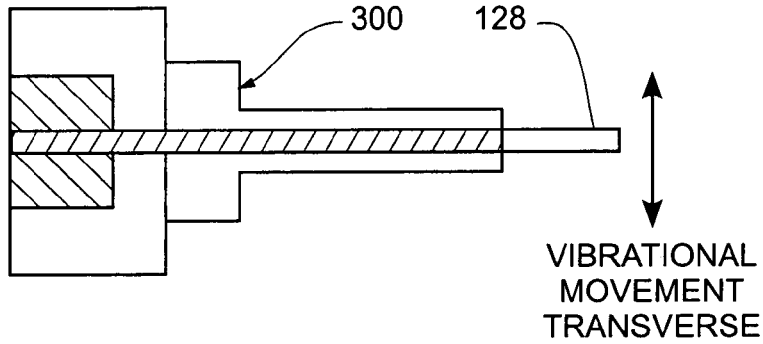
FIG. 10 is a cross sectional view of a sheath according to another embodiment of the invention.

FIG. 10 is a cross sectional view of a sheath according to another embodiment of the invention. In this embodiment, the exterior of the sheath is provided with a diaphragm 300 instead of a bellow or a plurality of bellows.

Figure 11:
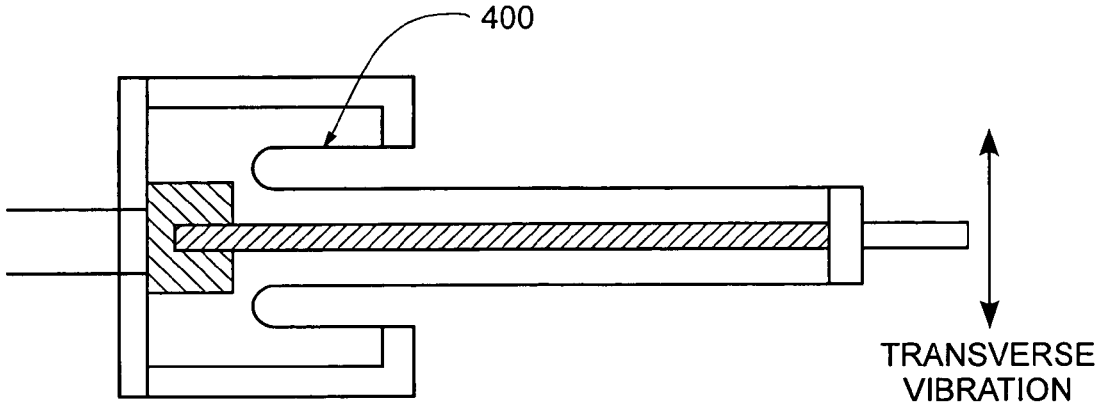
FIG. 11 is a cross sectional view of another sheath according to another embodiment of the invention.

FIG. 11 is a cross sectional view of another sheath according to another embodiment of the invention. In this embodiment, the sheath has a transverse spring 400 formed on its proximal end to replace the bellow or diaphragm.

Figure 12:
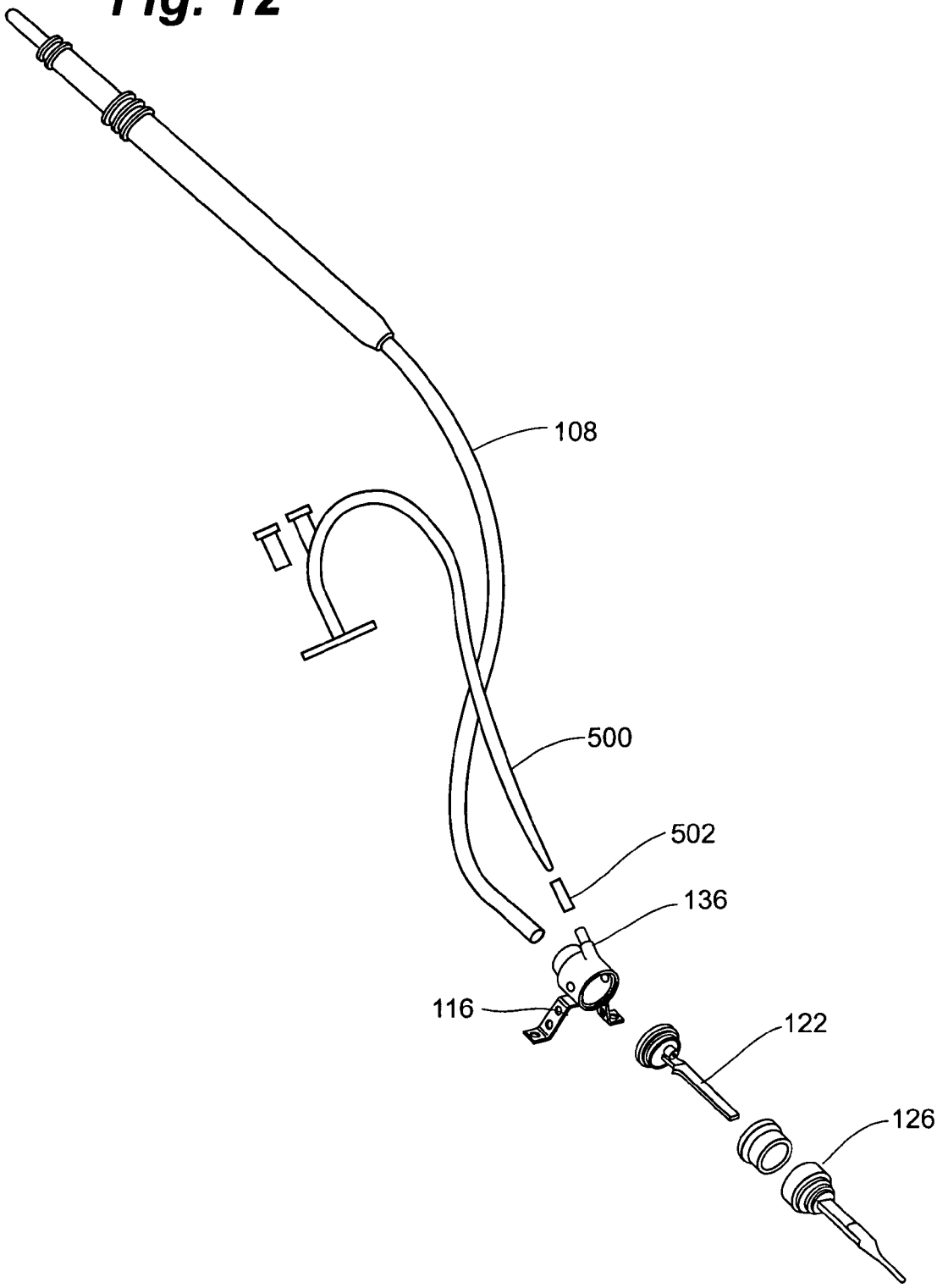
FIG. 12 is an exploded view of a driver assembly according to an embodiment of the invention illustrating a placement mechanism.

FIG. 12 is an exploded view of a driver assembly according to an embodiment of the invention illustrating a placement mechanism. U.S. Pat. No. 6,730,015, assigned to the present assignee, and hereby incorporated by reference herein, discloses a flexible supports for transducer assemblies of the type in which the embodiments of the invention are incorporated. The flexible support have an installation wire 500 coupled to the installation slot 136 in housing 116. The installation wire 136 has at one end a connecting pin 502 that is inserted in the installation wire socket formed in the housing. In an embodiment, both the connecting pin and the installation socket have an antirotational feature in the sense that once the wire 500 is inserted in the installation wire socket, it can not rotate with respect to the installation socket. In order to accomplish this, the connector pin may have a square, rectangular, triangular shape, for example, as long as it is not cylindrical. The installation socket has a complementary shape to accommodate the connector pin.

The transducer assemblies according to the embodiments described herein are hermetically sealed to provide a fully implantable device.

The embodiments described above are for exemplary purposes only and are not intended to limit the scope of he embodiments of the invention. Various modifications and extensions of the described embodiments will be apparent to those skilled in the art and are intended to be within the scope of the invention as defined by the claims which follow.

What is claimed is:

1. A hearing aid device comprising:

a transducer assembly having a proximal and distal end and a longitudinal axis coupling the proximal and distal end of the transducer assembly;

a sheath disposed over the transducer assembly and coaxial therewith, the sheath having a proximal end and a distal end;

a housing disposed over the proximal end of the transducer assembly, wherein the proximal end of the sheath is hermetically sealed to the housing and the distal end of the sheath is hermetically sealed about the distal end of the transducer assembly;

wherein the sheath is made from a biocompatible material;

wherein the biocompatible material is a biocompatible metal;

wherein the biocompatible metal is selected from the group consisting of gold, titanium, stainless steel, platinum-iridium, plastic and platinum;

wherein the transducer assembly includes a piezoelectric transducer; and wherein the sheath is provided with a plurality of bellows on its outer surface located adjacent to its proximal end to allow the piezoelectric transducer to flex in a direction substantially perpendicular to its longitudinal axis.

2. A hearing aid device comprising:

a transducer assembly having a proximal and distal end and a longitudinal axis coupling the proximal and distal end of the transducer assembly;

a sheath disposed over the transducer assembly and coaxial therewith, the sheath having a proximal end and a distal end;

a housing disposed over the proximal end of the transducer assembly, wherein the proximal end of the sheath is hermetically sealed to the housing and the distal end of the sheath is hermetically sealed about the distal end of the transducer assembly;

a pin located at the distal end of the sheath, wherein the pin has a rod projecting therefore for coupling the hearing aid device to a structure located in the middle ear of a human being; and wherein the entire hearing aid device except for the rod of the pin is coated in a conformal layer.

3. A hearing aid device comprising:

a transducer assembly having a proximal and distal end and a longitudinal axis coupling the proximal and distal end of the transducer assembly;

a sheath disposed over the transducer assembly and coaxial therewith, the sheath having a proximal end and a distal end;

a housing disposed over the proximal end of the transducer assembly, wherein the proximal end of the sheath is hermetically sealed to the housing and the distal end of the sheath is hermetically sealed about the distal end of the transducer assembly; and wherein the sheath has a longitudinal body wherein the longitudinal body is of rectangular cross section.

4. A hearing aid device comprising:

a transducer assembly having a proximal and distal end and a longitudinal axis coupling the proximal and distal end of the transducer assembly;

a sheath disposed over the transducer assembly and coaxial therewith, the sheath having a proximal end and a distal end;

a housing disposed over the proximal end of the transducer assembly, wherein the proximal end of the sheath is hermetically sealed to the housing and the distal end of the sheath is hermetically sealed about the distal end of the transducer assembly; and wherein the sheath has a longitudinal body wherein the longitudinal body is of square cross section.

5. A device for hermetically sealing a hearing aid device including a piezoelectric transducer having a proximal end and a distal end and a longitudinal axis coupling the proximal and distal ends of the piezoelectric transducer, the device comprising:

a sheath having a proximal end and a distal end, the sheath defining a lumen there between wherein the lumen is dimensioned to receive the piezoelectric transducer therein, the lumen being coaxial with the longitudinal axis of the piezoelectric transducer; and a pin located at the distal end of the sheath wherein the sheath is hermetically sealed about the piezoelectric transducer.

6. A device for hermetically sealing a hearing aid device having a transducer having a proximal end and a distal end and a longitudinal axis coupling the proximal and distal ends of the transducer, the device comprising:

a sheath having a proximal end and a distal end, the sheath defining a lumen there between wherein the lumen is dimensioned to receive the transducer therein;

a pin located at the distal end of the sheath wherein the sheath is hermetically sealed about the transducer;

wherein the sheath is made from a biocompatible material;

wherein the biocompatible material is a biocompatible metal;

wherein the biocompatible metal is selected from the group consisting of gold, titanium, stainless steel, platinum-iridium, plastic and platinum;

wherein the transducer assembly includes a piezoelectric transducer; and wherein the sheath is provided with a plurality of bellows on its outer surface located adjacent to its proximal end to allow the piezoelectric transducer to flex in a direction substantially perpendicular to its longitudinal axis.

7. A device for hermetically sealing a hearing aid device having a transducer having a proximal end and a distal end and a longitudinal axis coupling the proximal and distal ends of the transducer, the device comprising:

a sheath having a proximal end and a distal end, the sheath defining a lumen there between wherein the lumen is dimensioned to receive the transducer therein;

a pin located at the distal end of the sheath wherein the sheath is hermetically sealed about the transducer;

wherein the distal end of the sheath is open; and an epoxy bond coupled to the distal end of the sheath to hermetically seal the distal end of the sheath to the distal end of the transducer assembly.

8. A device for hermetically sealing a hearing aid device having a transducer having a proximal end and a distal end and a longitudinal axis coupling the proximal and distal ends of the transducer, the device comprising:

a sheath having a proximal end and a distal end, the sheath defining a lumen there between wherein the lumen is dimensioned to receive the transducer therein;

a pin located at the distal end of the sheath wherein the sheath is hermetically sealed about the transducer;

wherein the pin has a rod projecting therefore for coupling the hearing aid device to a structure located in the middle ear of a human being; and wherein the entire hearing aid device except for the rod of the pin is coated in a conformal layer.

9. A device for hermetically sealing a hearing aid device having a transducer having a proximal end and a distal end and a longitudinal axis coupling the proximal and distal ends of the transducer, the device comprising:

a sheath having a proximal end and a distal end, the sheath defining a lumen there between wherein the lumen is dimensioned to receive the transducer therein;

a pin located at the distal end of the sheath wherein the sheath is hermetically sealed about the transducer; and wherein the lumen is of rectangular cross section.

10. A device for hermetically sealing a hearing aid device having a transducer having a proximal end and a distal end and a longitudinal axis coupling the proximal and distal ends of the transducer, the device comprising:

a sheath having a proximal end and a distal end, the sheath defining a lumen there between wherein the lumen is dimensioned to receive the transducer therein;

a pin located at the distal end of the sheath wherein the sheath is hermetically sealed about the transducer; and wherein the lumen is of square cross section.

11. A hearing aid device comprising:

a transducer assembly including a piezoelectric transducer having a proximal end and a distal end and a longitudinal axis coupling the proximal and distal ends of the piezoelectric transducer;

a sheath disposed over the transducer assembly, the sheath having a proximal end and a distal end, the sheath being coaxial with the longitudinal axis of the piezoelectric transducer; and a housing disposed over the proximal end of the transducer assembly, wherein the proximal end of the sheath is hermetically sealed to the housing and the distal end of the sheath is hermetically sealed about the distal end of the transducer assembly.

12. A hearing aid device according to claim 11 wherein the sheath has a wall thickness ranging from about 0.0005 inches to about 0.010 inches.

13. A hearing aid device according to claim 11 wherein the sheath has a wall thickness of about 0.002 inches.

14. A hearing aid device according to claim 11 wherein the sheath is adapted to allow the piezoelectric transducer to flex in a direction substantially perpendicular to its longitudinal axis.

15. A hearing aid device according to claim 14 wherein the sheath has a diaphragm located adjacent to its proximal end to allow the piezoelectric transducer to flex in a direction substantially perpendicular to its longitudinal axis.

16. A hearing aid device according to claim 14 wherein the sheath has a transverse spring located adjacent to its proximal end to allow the piezoelectric transducer to flex in a direction substantially perpendicular to its longitudinal axis.

17. A hearing aid device according to claim 14 wherein the sheath is provided with a bellow on its outer surface located adjacent to its proximal end to allow the piezoelectric transducer to flex in a direction substantially perpendicular to its longitudinal axis.

18. A hearing aid device according to claim 17 wherein the sheath is provided with a plurality of bellows on its outer surface located adjacent to its proximal end to allow the piezoelectric transducer to flex in a direction substantially perpendicular to its longitudinal axis.

19. A device for hermetically sealing a hearing aid device according to claim 5 wherein the distal end of the sheath is open.

20. A device for hermetically sealing a hearing aid device according to claim 5 wherein the sheath has a wall thickness ranging from about 0.0005 inches to about 0.01 inches.

21. A device for hermetically sealing a hearing aid device according to claim 5 wherein the sheath has a wall thickness of about 0.002 inches.

22. A device for hermetically sealing a hearing aid device according to claim 5 wherein the sheath is adapted to allow the piezoelectric transducer to flex in a direction substantially perpendicular to its longitudinal axis.

23. A device for hermetically sealing a hearing aid device according to claim 22 wherein the sheath has a diaphragm located adjacent to its proximal end to allow the piezoelectric transducer to flex in a direction substantially perpendicular to its longitudinal axis.

24. A device for hermetically sealing a hearing aid device according to claim 22 wherein the sheath has a transverse spring located adjacent to its proximal end to allow the piezoelectric transducer to flex in a direction substantially perpendicular to its longitudinal axis.

25. A device for hermetically sealing a hearing aid device according to claim 22 wherein the sheath is provided with a bellow on its outer surface located adjacent to its proximal end to allow the piezoelectric transducer to flex in a direction substantially perpendicular to its longitudinal axis.

26. A device for hermetically sealing a hearing aid device according to claim 25 wherein the sheath is provided with a plurality of bellows on its outer surface located adjacent to its proximal end to allow the piezoelectric transducer to flex in a direction substantially perpendicular to its longitudinal axis.

* * * * *